US010617925B2

(12) United States Patent
Bulens

(10) Patent No.: US 10,617,925 B2
(45) Date of Patent: Apr. 14, 2020

(54) AIR RESISTANCE TRAINING DEVICE

(71) Applicant: Joe Bulens, Ankeny, IA (US)

(72) Inventor: Joe Bulens, Ankeny, IA (US)

( * ) Notice: Subject to any disclaimer, the term of this patent is extended or adjusted under 35 U.S.C. 154(b) by 0 days.

(21) Appl. No.: 14/923,202

(22) Filed: Oct. 26, 2015

(65) Prior Publication Data

US 2016/0038812 A1 Feb. 11, 2016

Related U.S. Application Data

(63) Continuation-in-part of application No. 13/961,172, filed on Aug. 7, 2013, now abandoned.

(60) Provisional application No. 61/680,586, filed on Aug. 7, 2012.

(51) Int. Cl.
*A63B 69/00* (2006.01)
*A63B 43/00* (2006.01)

(52) U.S. Cl.
CPC ..... *A63B 69/00* (2013.01); *A63B 69/0002* (2013.01); *A63B 2043/001* (2013.01)

(58) Field of Classification Search
CPC . A63B 43/002; A63B 69/00; A63B 2043/001; A63B 2225/01; A63B 43/007; A63H 33/20
USPC ..... 473/281, 422, 438, 446, 451, 459, 575, 473/576, 579, 580, 613
See application file for complete search history.

(56) References Cited

U.S. PATENT DOCUMENTS 2,721,716 A 10/1955 Beadle
2,793,869 A * 5/1957 Braun ..... A63C 9/002 280/623
2,993,667 A 7/1961 Cushman
3,147,979 A 9/1964 Wolfe
3,378,218 A 4/1968 Robertson et al.
5,398,928 A 3/1995 Rudell et al.
5,755,405 A 5/1998 Socha et al.
5,803,838 A 9/1998 DeMarini et al.
6,503,119 B1 1/2003 Lapointe
8,272,971 B2 9/2012 Tutmark
8,640,993 B2 2/2014 Culbreath
2006/0135291 A1 * 6/2006 Biegen ..... A63B 21/0088 473/451
2008/0224429 A1 * 9/2008 Watson ..... B62B 15/00 280/19
2010/0255939 A1 10/2010 York
(Continued)

FOREIGN PATENT DOCUMENTS

WO WO 9810840 A2 * 3/1998 ..... A63B 21/0552

OTHER PUBLICATIONS

Aeromax 2000, "The Original Tangle Free Toy Parachute" http://aeromaxtoys.com/Aeromax2000.html, captured on Apr. 9, 2003.

*Primary Examiner* — Laura Davison
(74) *Attorney, Agent, or Firm* — McKee, Voorhees & Sease, PLC

(57) ABSTRACT

A training device that includes a sports implement connected to an air resistance member in near engagement by a connection system. In one arrangement, the air resistance member has a first and a second layer of material. The training device reduces the distance the sports implement travels by application of air resistance once airborne once thrown, kicked, struck, or otherwise moved by an athlete. While still under the influence of the athlete, the training device's resistance to air strengthens the athlete during the course of athletic movements.

15 Claims, 3 Drawing Sheets

(56) References Cited

U.S. PATENT DOCUMENTS

| | | | | |
|---|---|---|---|---|
| 2011/0133036 | A1* | 6/2011 | Goddard | B64D 1/16<br>244/137.3 |
| 2013/0310190 | A1* | 11/2013 | O'Day, Jr. | A63B 43/00<br>473/281 |
| 2014/0045626 | A1 | 2/2014 | Bulens | |
| 2015/0367219 | A1* | 12/2015 | Bibbens | A63B 69/0071<br>473/430 |

* cited by examiner

AIR RESISTANCE TRAINING DEVICE

CROSS-REFERENCE TO RELATED APPLICATIONS

This is a Continuation-in-part Application of U.S. Ser. No. 13/961,172 filed Aug. 7, 2013, which claims priority to Provisional Application U.S. Ser. No. 61/680,586 filed on Aug. 7, 2012, all of which are herein incorporated by reference in their entirety.

BACKGROUND OF THE INVENTION

This invention is related to training devices and more particularly to a training device to improve physical performance.

There are many physical activities such as tennis, baseball, softball, football, and soccer that require multiple athletes in order to practice. If one wants to practice alone, the process involves time and effort retrieving balls after they are thrown, kicked, or struck. As an example, punting a football alone might require one to traverse back and forth thirty to sixty yards over and over. Further, most practice requires an outdoor field, fenced or netted area, or a large indoor facility that are not always available or cost-effective.

Devices that reduce the distance an object travels after being hit or thrown are known in the art. For instance, Wolfe (U.S. Pat. No. 3,147,979) discloses a golf ball that has an attachment device that passes a series of loops through the center of the golf ball and to a parachute some distance away that prevents the ball from traveling farther once it is struck.

Despite its advantages, this device and others like it, problems remain.

In particular, these devices only slow the velocity of the object after it has been struck, kicked, or thrown. As such, these devices do not provide any additional resistance to the athlete during the act of throwing or striking. Resistance training is common in physical training regimes because it has been found to increase the athlete's strength. Therefore, training is not maximized by not applying the addition resistance to the body of the athlete throughout the mechanics of throwing the ball or swinging the racket, bat, club, etc.

Other training devices have addressed some of these deficiencies. For example, DeMarini et al. (U.S. Pat. No. 5,803,838) discloses a drogue chute that is attached to a baseball bat by a belt sleeve that wraps around the top portion of the baseball bat and extends outwards a distance from the bat and attaches to suspension lines that ultimately lead to a chute. Although this device and others like it provide some degree of air resistance when a baseball bat is swung, they too suffer from a number of deficiencies.

In particular, the distance from the baseball bat to the chute reduces the effectiveness of the training device as the swing of the bat is partially completed before the chute is filled with air to provide air resistance to the athlete. Further, the applicability of such a device is ineffective on balls as the belt sleeve would interrupt the athlete's ability to grip the ball properly. Further still, the belt sleeve is not durable enough to operate on a ball that is being struck, as it would loosen and disengage from the ball, rendering the chute system useless for its strengthening aspects and retrieval aspects. In addition to these deficiencies, the prior art designs are cumbersome, require numerous parts and components, often require long suspension cables that can become entangled when used or stored, and often require highly destructive methods to implement. As such, a training device is desired that addresses these deficiencies.

Thus it is a primary objective of the present invention to provide a training device that improves upon the state of the art.

Another objective of the present invention is to provide a training device that reduces the distance traveled when thrown, kicked, or struck.

Yet another objective of the present invention is to provide a training device that increases the strength of the athlete by increasing the air resistance applied when the training device is thrown, kicked, or struck.

Another objective of the present invention is to provide a training device that can be used inside.

Yet another objective of the present invention is to provide a training device that increases resistance. Another objective of the present invention is to provide a training device that does not require the use of nets or fences.

Yet another objective of the present invention is to provide a training device that maximizes air resistance.

Another objective of the present invention is to provide a training device improves the use of training time.

Yet another objective of the present invention is to provide a training device that removes the need for weighted training devices, Another objective of the present invention is to provide a training device that forces athletes to drive through the motions of sound body mechanics. Yet another objective of the present invention is to provide a training device that does not inhibit the grip of the athlete during use.

Another objective of the present invention is to provide a training device that improves athletic performance over the use of regulation sports implements during training.

Yet another objective of the present invention is to provide a training device that is cost effective, user friendly, and simple to make.

These and other objects, features, or advantages of the present invention will become apparent from the specification and claims.

SUMMARY OF THE INVENTION

The present invention is a training device that includes a sports implement connected to an air resistance member in near engagement by a connection system, such that when the sports implement is moved immediate air resistance is applied to the movement of the sports implement. Further, this causes the athlete to drive though the motion of the athlete's athletic action such that proper body mechanics are retained. The resistance applied by air captured by the air resistance mechanism strengthens the athlete's muscles. For example, some athletes have noted increased throwing speeds of a baseball of 3 to 4 MPH over a period of a summer training using the present invention. Other improvements include increased arm speed and velocity, as well as increased throwing distance and power. Importantly, the strengthening aspects of the present invention are achieved without the addition of a weighted system beyond the nominal weight of the connection system and air resistance member. Additionally, the training device reduces the time needed for training, as in one embodiment a 45-minute session is equivalent to a 5-hour session using a regulation sports implement.

In addition, the training device allows for training in confined or crowded spaces, or solo training. More particularly, the training device reduces the distance an airborne sports implement travels—in some instances up to 1/10 the distance of a regulation sports implement. The harder the sports implement is thrown, kicked, or struck the more air resistance is applied, thereby reducing the distance traveled by the sports implement, making it ideal for crowded or confined training facilities, or in solo training situations where retrieval over long distances would be time consuming.

DETAILED DESCRIPTION OF THE DRAWINGS

Figure 1A:
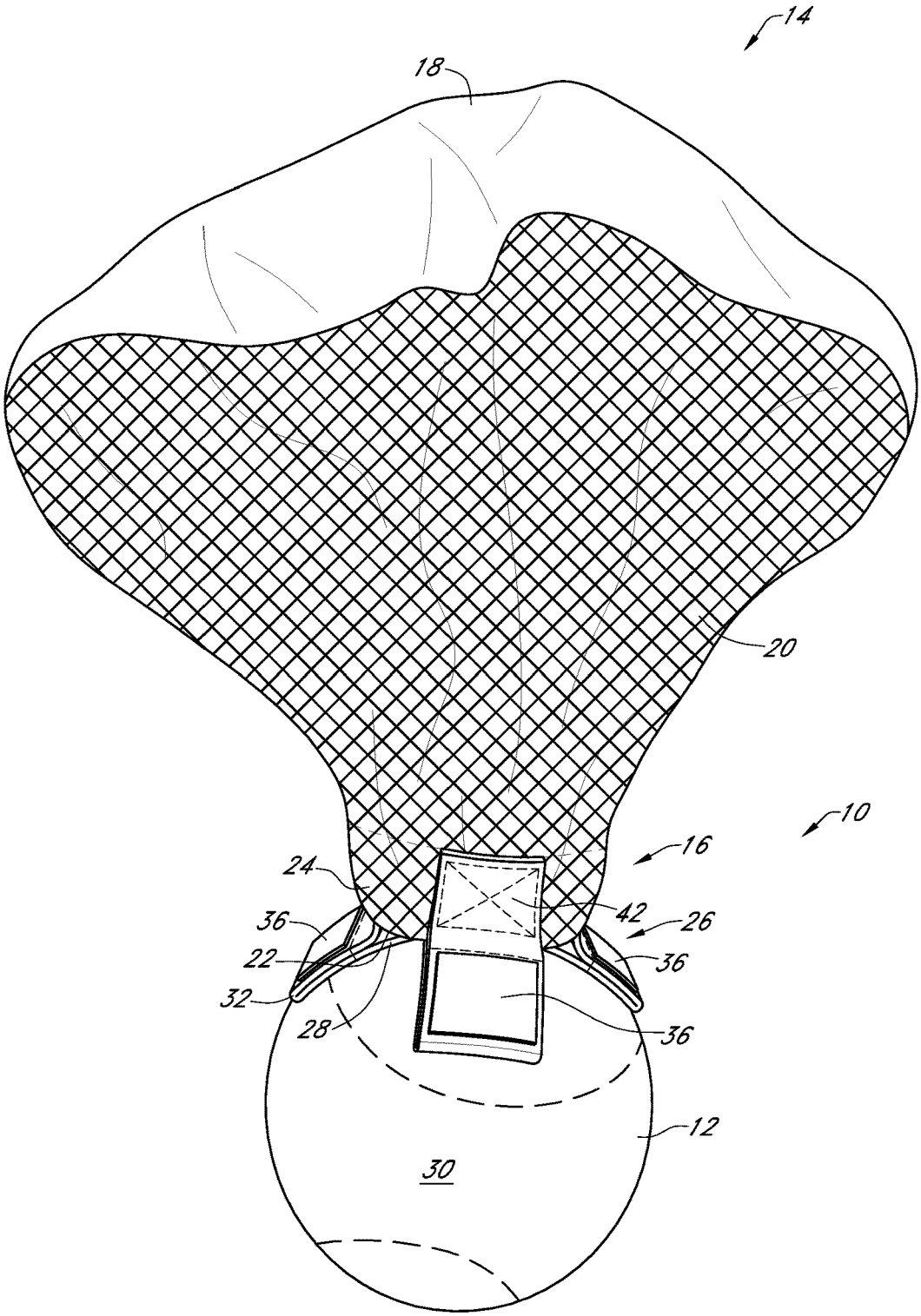
FIG. 1A is a side perspective view of a training device.
Figure 1B:
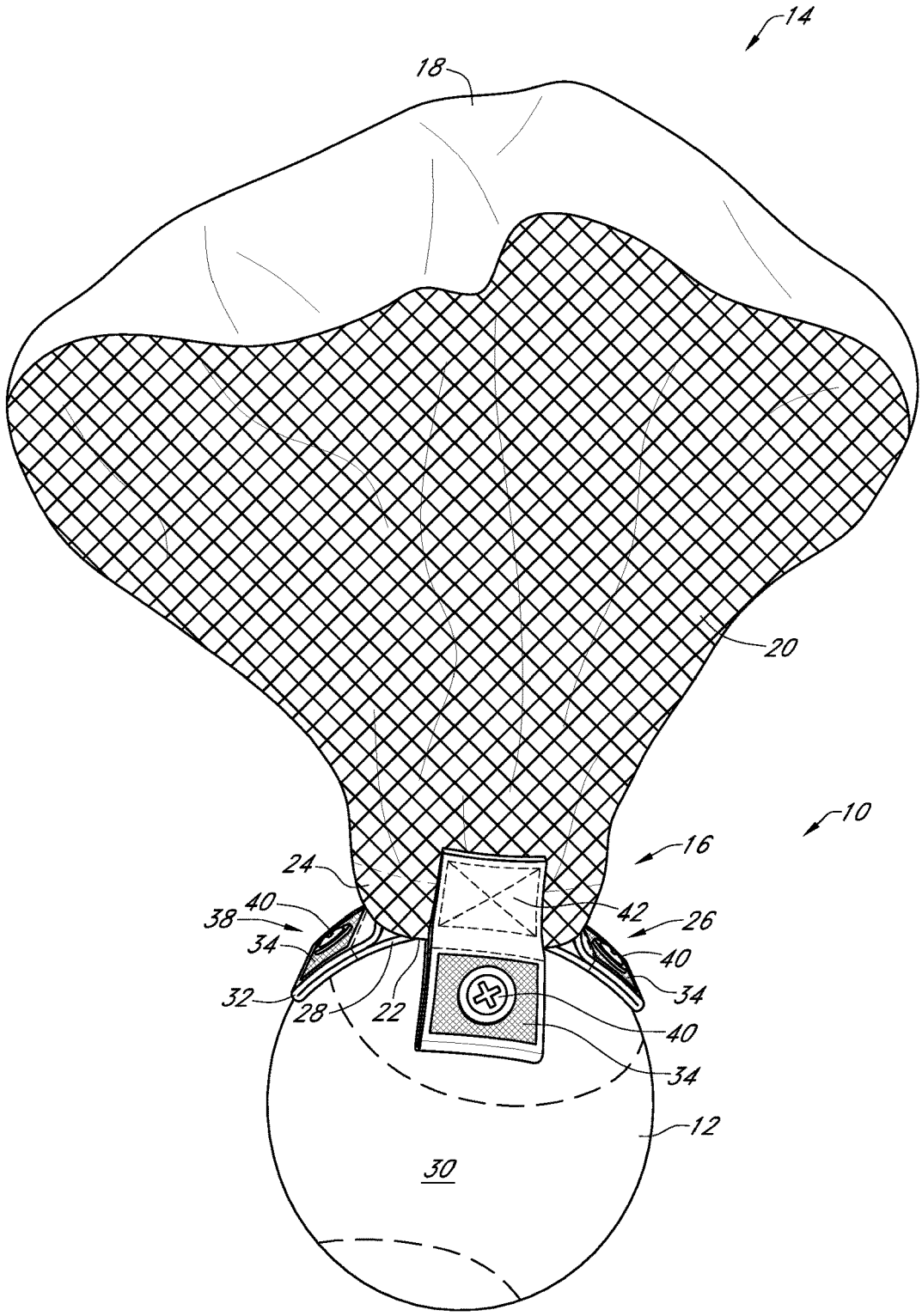
FIG. 1B is a side perspective view of a training device.
Figure 2:
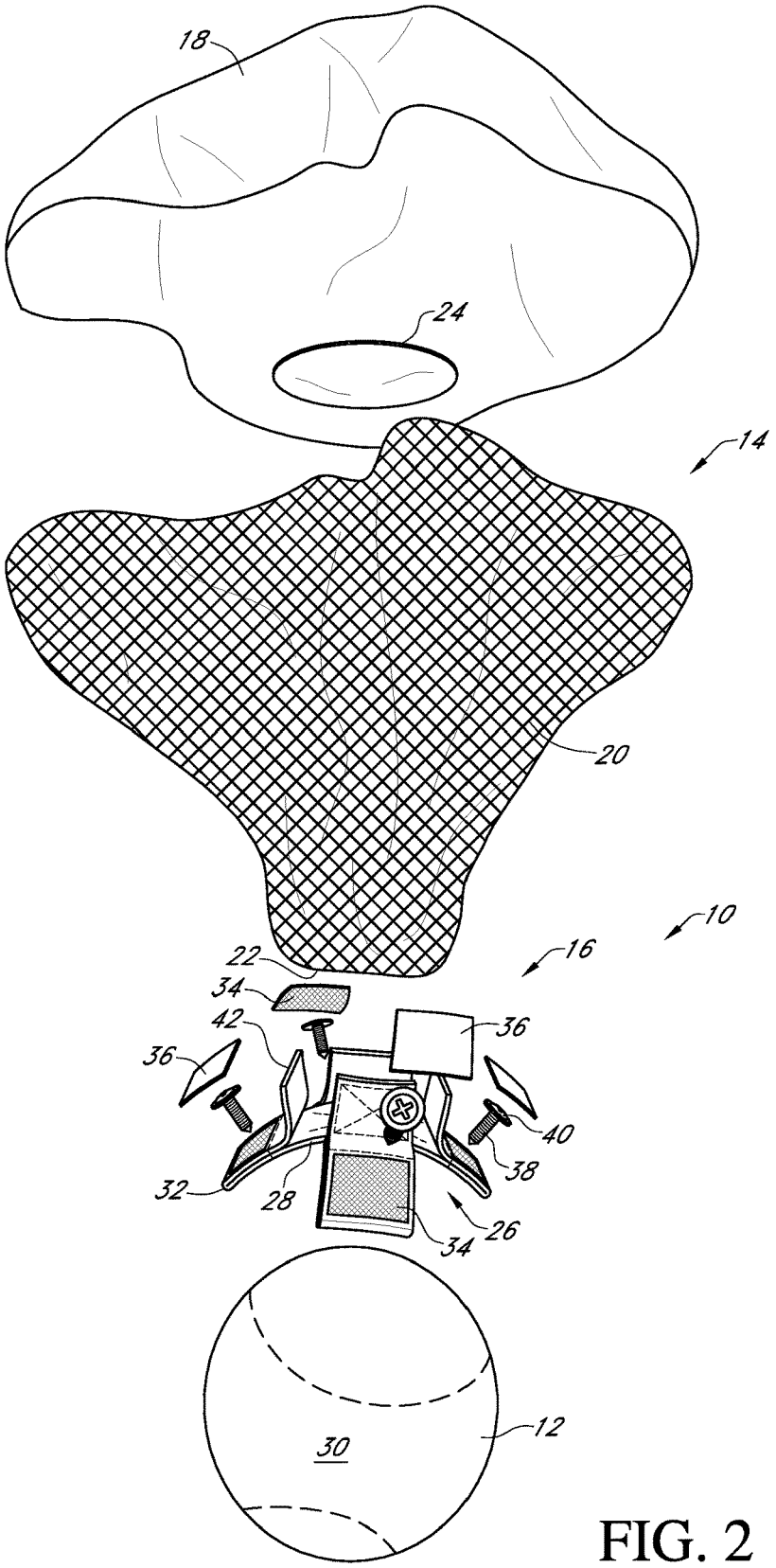
FIG. 2 is a side exploded view of a training device.

Referring to the Figures, the training device 10 includes a sports implement 12, an air resistance member 14, and a connection system 16. As shown, the sports implement 12 is held in near engagement to the air resistance member 14 by the connection system 16. In some embodiments, the air resistance member is 14 is in actual engagement with at least a portion of the sports implement 12.

In the illustrated embodiment, the sports implement 12 is a regulation baseball. In another embodiment, the sports implement 12 is a softball, football, soccer ball, baseball bat, golf club, soccer ball, golf ball, or the like.

The air resistance member 14 has a first layer of material 18 that in one embodiment is solid and does not allow air to pass though. In an illustrative embodiment, the first layer of material 18 is nylon or other wind-resistant material such as silk or the like. The first layer of material 18 is circular in shape, but in other arrangements can be any other suitable size and shape.

Attached to the outer perimeter of the first layer of material 18 is a second layer of material 20. In one embodiment, the second layer of material 20 is circular in shape, but can be any other suitable size and shape. For the ease of construction and labor and as shown in the Figures, the second layer of material 20 is a uniform piece of material, which reduces the need for cutting away a central portion 22 of the second layer of material 20.

In the illustrated embodiment, the second layer of material 20 is attached to the first layer of material 18 such that the layers 18, 20 are connected along the entirety of their respective outer perimeters. The first layer of material 18 and the second layer of material 20 are attached in any conventional way such as gluing, sewing, snapping, Velcro, or the like. In the embodiment shown, the first layer of material 18 and the second layer 20 are sewn together.

In the arrangement shown, the second layer of material 20 is mesh. The use of mesh prevents the second layer of material 20 from becoming tangled as occurs in other types of resistance members. In other arrangements, the second layer of material 20 can be made or other materials that are permeable in such a manner that structure is provided to the resistance member 12 while allowing air to pass through the second layer of material 20 to engage the first layer of material 18 to provide air resistance.

The connection system 16 includes an interior ring or disc 24 that in one embodiment is circular in shape but can be of any suitable size and shape is made of nylon, but can be made of any durable material, such as canvas or the like. The interior disc 24 is positioned within the air resistance member 14 between the first layer of material 18 and the second layer of material 20.

In one arrangement, the interior disc 24 is positioned on the central portion 22 of the second layer of material 20. In an illustrative embodiment, the interior disc 24 is adhered to the second layer of material 20 or stitched into placed by any conventional means.

The connection system 16 also includes one or more straps 26. The straps 26 in one embodiment are nylon, but can be made of any durable material, such as canvas or the like. The individual strap 26 has a central section 28 that is positioned along the exterior surface 30 of the sports implement 12. As shown in the Figures, the central section 28 is not positioned within the sports implement 12 and the central section 28 is in close proximity and in near engagement with the exterior surface 30. As in the depicted embodiment, when two or more straps 26 are used, the central sections 28 are connected to provide additional durability to the connection system 16 and the overall training device 10. In one arrangement, the connection between the central sections 28 are made by sewing, but other conventional methods are contemplated. In one arrangement, when two straps 26 are used, the straps 26 are positioned perpendicularly to one another to maximize the connectability of the connection system 16 discussed further below.

In one embodiment, one or more straps 26 are folded over at each end of the strap 26 in the direction opposite of the exterior surface 30 of the sports implement 12 to form folded sections 32. In this arrangement, a cover connector 34 is attached to the folded section 32 on the side opposite of the exterior surface 30 of the sports implement 12, which receives a cover 36. As shown in the Figures, the cover connector 34 is one side of Velcro, but other connectors such as a grommet, snap, and the like are considered. In still other embodiments, no cover connector 34 or cover 36 is present.

A fastening member 38 is passed through the folded sections 32 of the strap 26 and into the sports implement 12 to hold the central section 28 in place. In one arrangement, the central section 28 is pulled tightly against the surface 30 of the sports implement 12 such that when the fastening members 38 passed through the folded section 32 the central section 28 moves very little if at all. The fastening member 38 in one arrangement has a head 40 that engages the top of the folded section 32 opposite of the exterior surface 30 of the sports implement 12 and pulls it downward, such that the folded section 32 is held between the head 40 and the exterior surface 30. In the embodiments that include a cover connector 34 and cover 36, the fastening member 38 also passes through the cover connector 34. In this arrangement, the cover 36 is placed over the fastening member 38, and head 40 if present, so that the athlete's skin does not come into contact with the fastening member 38, which may be abrasive.

In one arrangement, the folded section or sections 32 are less than 2 cm in length, but in other embodiments are less than 1.5 cm in length. In this fashion, the folded sections 32 are sized sufficiently to receive the fastening member 32 without risk of tearing as the double layer created by the folded sections 32 adds durability. At the same time, the length of the folded sections 32 is contemplated to retain engagement or near engagement of the folded sections 32 with the exterior surface 30 when a fastening member 38 thereby restricting the amount of overall movement of the strap or straps 26. In the embodiment shown, the central sections 28 and the folded sections 32 of the straps 26 cover ⅙ or less of the exterior surface 30 of the sports implement 12 so that when the sports implement 12 is a ball, the straps 26 do not inhibit the grip the athlete has on the ball. For example, in one embodiment, a sports implement 12 that is a baseball has approximately six sections, of which, only one section would be covered by the straps 26. In other embodiments, the straps 26 are positioned on the sports implement 12 such that they do not extend around the entirety of the sports implement 12 to avoid inhibiting the use of the sports implement 12.

At each end of the straps 26 are attachment sections 42 that extend inwardly from the folded sections 32. As shown in the Figures, when two straps 26 are used, four attachment sections 42 extend upwards as part of the connection system 16. In one arrangement, the attachment sections 32 have a length of no more than 2.5 cm, but other lengths are contemplated. In alternative arrangements, the folded sections 32 and the attachment sections 42 are separate pieces of material that are sewn or otherwise attached to the straps 26 connected to sports implement 12.

In the embodiment shown, the one or more attachment sections 42 are attached to the interior disc 24 by sewing. The presence of the central portion 22 of the second layer of material 20 allows the attachment sections 42 to also attach to the second layer of material 20, thereby increasing durability. In other embodiments the attachment sections 42 are attached to the interior disc 24 by any conventional means that is suitable and durable. In other possible arrangements, the attachment sections 42 attach directly to the second layer of material 20 without the presence of the interior disc 24.

The attachment sections 42 are attached to the interior disc 24 such that all or nearly all of the surface of the attachment section 42 is in contact with the interior disc 24. In this way, the air resistance member 14 is nearly engaging the sports implement 12. In one arrangement, the maximum distance between the sports implement 12 and the air resistance member 14 is less than 2.0 cm. In other arrangements, the distance is less than 1.0 cm and less than 0.5 cm. This allows the air resistance member 14 to be filled with air immediately when moved and thereby providing immediate air resistance. Additionally, the near engagement of the air resistance member 14 to the sports implement 14 reduces movement of the connection system 16, thereby improving the durability of the training device and the air resistance provided.

In operation, while the training device 10 is not in motion, the air resistance member 14 is in a retracted or closed position adjacent to the sports implement 12. Next, the sports implement 12 is either thrown, kicked, struck, or swung by the athlete causing the sports implement 12 to move. Upon moving, the near engagement created by the connection system 16 of the air resistance member 14 to the sports implement 12 causes immediate air resistance to the motion of the athlete's movement. This in turn strengthens the athlete who must use more muscle strength to complete the same throw in comparison to using a regulation sports implement 12 without the need for additional weight. The increase in resistance also reduces the duration needed to achieve the same results. In addition, the immediate air resistance formed by the training device 10 forces the athlete to drive through the athletic motion they are performing in the proper form, thereby maintaining proper body mechanics that would depreciate when resistance is not present.

Once the training device 10 is airborne, the sports implement 12 rotates until the connection system 16 is on the trailing side of the sports implement 12. At that point, the air resistance member 14 quickly slows the velocity of the sports implement 12 causing it to land a significant distance shorter than a regulation sports implement 12. Additionally, the harder the sports implement 12 is thrown, the more air resistance is created.

Therefore, training device 10 has been provided that reduces the distance traveled when thrown, kicked, or struck, increases the strength of the athlete by increasing the air resistance applied when the training device is thrown, kicked, or struck, can be used inside, increases resistance, does not require the use of nets or fences, maximizes air resistance, improves the use of training time, removes the need for weighted training devices, forces athletes to drive through the motions of sound body mechanics, does not inhibit the grip of the athlete during use, improves athletic performance over the use of regulation sports implements during training, is cost effective, user friendly, simple to make, and improves upon the art. Accordingly, a training device has been disclosed that at the very least meets all the stated objectives.

From the above discussion and accompanying figures and claims it will be appreciated that the training device 10 offers many advantages over the prior art. It will be appreciated by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included within the spirit and purview of this application.

What is claimed is:

1. A training device comprising:

a ball sized to be gripped in a person's hand for throwing;

an air resistance member having a first layer of material and a second layer of material, wherein the first layer of material is connected to the second layer of material along an outer perimeter of the first layer of material;

the first layer of material being substantially non-permeable to air;

the second layer of material being air permeable;

an interior disc positioned between the first layer of material and the second layer of material of the air resistance member and connected to a central portion of the second layer of material;

a connection system connecting the air resistance member to the ball, the connection system having two crossed straps each having a central portion positioned along an exterior surface of the ball and a folded section at each end connected to the exterior surface of the ball, and each strap having upstanding sections extending outwardly from the ball and being attached to the interior disc; and the air resistance member being collapsible.

2. The training device of claim 1 wherein a distance between the ball and the air resistance member is less than 2.0 cm.

3. The training device of claim 1 wherein the folded sections each receive at least one fastening member through the folded section, such that the folded section is held in place between a head of the fastening member and the exterior surface of the ball.

4. The training device of claim 3 further comprising each folded section having a cover connector and a cover that is removably received on the cover connector.

5. The training device of claim 1 wherein the two straps are positioned perpendicularly to one another and connected along the central portion of each of the two straps.

6. The training device of claim 1 wherein when the ball is moved, a proximity of the air resistance member to the ball provides immediate resistance.

7. The training device of claim 1 wherein the connection system includes screws extending through the folded sections and into the ball.

8. A ball assembly for throwing, comprising:

a spherical ball;

a first strap having a central portion positioned along an exterior surface of the ball and opposite ends attached to the exterior surface of the ball at spaced apart points;

the strap having a pair of spaced apart upstanding sections extending outwardly from the exterior surface of the ball;

a collapsible parachute including a first mesh fabric attached to the upstanding sections and residing adjacent the ball and a second non-mesh fabric attached to an outer perimeter of the mesh fabric; and the parachute being movable from a closed position adjacent the ball when the ball is stationary and an open position when the ball is thrown.

9. The ball assembly of claim 8 further comprising a disc between the first and second fabrics and attached to the first mesh fabric and the upstanding sections of the strap.

10. The ball assembly of claim 8 wherein the strap resides on only one hemisphere of the ball without crossing an equator of the ball.

11. The ball assembly of claim 8 wherein the strap extends only partially around the ball.

12. The training device of claim 8 further comprising screws to secure the opposite ends of the strap to the ball.

13. The training device of claim 8 further comprising a second strap having a central portion positioned along the exterior surface of the ball and opposite ends attached to the exterior surface of the ball at spaced apart points, and having a pair of spaced apart upstanding sections extending outwardly from the ball and to which the first mesh fabric of the parachute is attached.

14. The training device of claim 13 wherein the first and second straps cross one another in a perpendicular orientation.

15. The training device of claim 8 wherein the upstanding sections are spaced inwardly from the opposite ends.

* * * * *